United States Patent [19]

Chinoporos et al.

[11] Patent Number: 4,719,175

[45] Date of Patent: Jan. 12, 1988

[54] NOVEL PYRAZOLE COMPOUNDS HAVING SILVER HALIDE DEVELOPMENT GROUPS

[75] Inventors: Efthimios Chinoporos, Belmont; Elbert M. Idelson, West Newton; Patrick F. King, Needham, all of Mass.

[73] Assignee: Polaroid Corporation, Cambridge, Mass.

[21] Appl. No.: 374,275

[22] Filed: May 3, 1982

[51] Int. Cl.[4] ..... G03C 5/30

[52] U.S. Cl. ..... 430/440; 430/224; 430/225; 430/483

[58] Field of Search ..... 430/224, 225, 440, 483

[56] References Cited

U.S. PATENT DOCUMENTS

| | | | |
|---|---|---|---|
| 2,289,367 | 7/1942 | Kendall | 430/483 |
| 3,252,990 | 5/1966 | Green et al. | 430/483 |
| 4,267,252 | 5/1981 | Idelson | 430/225 |
| 4,267,253 | 5/1981 | Idelson | 430/225 |
| 4,656,117 | 4/1987 | Chinoporos et al. | 430/225 |

*Primary Examiner*—Richard L. Schilling
*Attorney, Agent, or Firm*—Gaetano D. Maccarone

[57] ABSTRACT

There are described novel pyrazole compounds represented by the formula

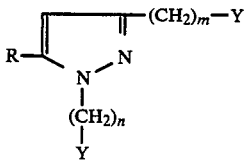

wherein Y is a silver halide developing substituent or a precursor thereof; R is —OH, —$NH_2$ or —NH-$SO_2$—$R_1$; $R_1$ is alkyl having from 1 to 6 carbon atoms or phenyl; and m and n are the same or different and each is an integer of from 1 to 6. The pyrazole compounds are useful as intermediates in the preparation of azo and azomethine dye developers or as silver halide developing agents.

1 Claim, No Drawings

NOVEL PYRAZOLE COMPOUNDS HAVING SILVER HALIDE DEVELOPMENT GROUPS

BACKGROUND OF THE INVENTION

This invention relates to novel pyrazole compounds which are useful in photographic applications and which are particularly useful as intermediates in the preparation of dye developers.

Dyes which also include a silver halide developing capability are well known in the photographic art. Such dyes are commonly referred to as "dye developers". U.S. Pat. Nos. 4,267,252 and 4,267,253 disclose chrome-complexed azo dye developers having an iminodiacetic acid ligand.

This application is directed to novel pyrazole compounds which have a silver halide developing capability and which are particularly useful in the preparation of dye developer compounds including those described in U.S. Pat. Nos. 4,267,252 and 4,267,253.

SUMMARY OF THE INVENTION

It is therefore the object of this invention to provide novel pyrazole compounds.

It is another object to provide novel pyrazole compounds which have a silver halide developing capability.

It is a further object to provide novel pyrazole compounds which are useful as intermediates in the preparation of dye developers.

BRIEF SUMMARY OF THE INVENTION

These and other objects and advantages of the invention are accomplished by providing novel pyrazole compounds represented by the formula

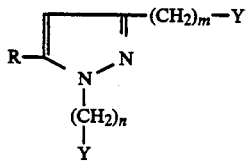

wherein Y is a silver halide developing substituent or a precursor thereof; R is —OH, —$NH_2$ or —NH-$SO_2$—$R_1$; $R_1$ is alkyl having from 1 to 6 carbon atoms or phenyl; and m and n are the same or different and each is an integer of from 1 to 6.

For the present invention a silver halide developing substituent is one containing a benzene or naphthalene nucleus containing at least a hydroxy and/or amino substituent ortho or para to another such substituent. Silver halide developing substituents of this type are known in the art as is evidenced, for example, by Neblette's Handbook of Photography and Reprography, 7th Edition, Van Nostrand Reinhold Company, Inc., (1977), pp 115–118. The hydroquinonyls constitute a preferred group of developing substituents. Included in this preferred group are substituted derivatives such as alkyl, phenyl and/or alkoxy substituted derivatives of hydroquinone.

Where Y is a precursor of a silver halide developing substituent the benzene or naphthalene nucleus contains a protective substituent ortho or para to another such substituent. Typical suitable protective groups include acyloxy, benzyloxy, ethyloxy, alkoxy, acetoxy or the like which can be converted or removed such as by hydrolysis to provide the silver halide developing substituents.

Compounds within the generic formula illustrated above are disclosed in the aforementioned U.S. Pat. Nos. 4,267,252 and 4,267,253.

DESCRIPTION OF THE PREFERRED EMBODIMENTS

Preferred pyrazole compounds according to the invention are represented by the formulas:

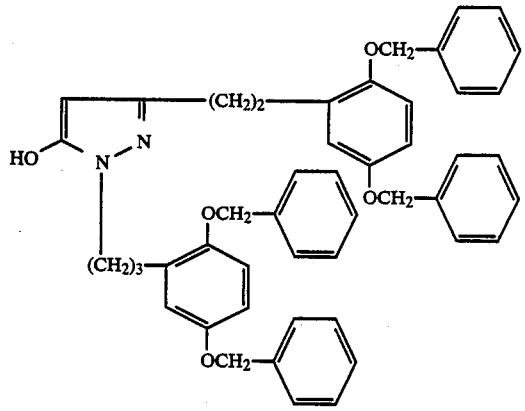

Compound I

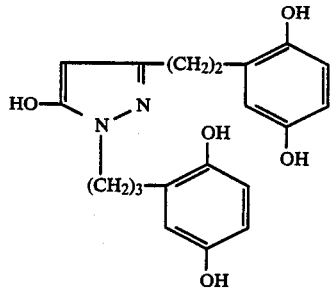

Compound II

The preparation of the novel pyrazole compounds of the invention can be carried out by reactions which are well known in the art and one such reaction sequence will be apparent from the disclosure which follows. Generally, the compounds wherein R is —OH can be made by reacting the salt of a blocked hydroquinone compound represented by the formula

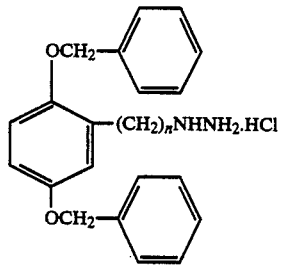

with a blocked hydroquinone represented by the formula

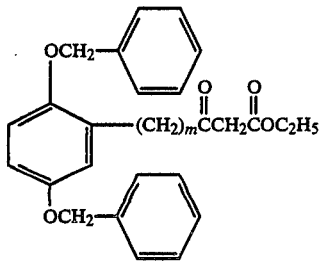

to give the blocked compound and subsequently converting the blocking groups to hydroxy groups such as by reaction with boron tribromide. Reacting the salt shown above with a compound represented by the formula

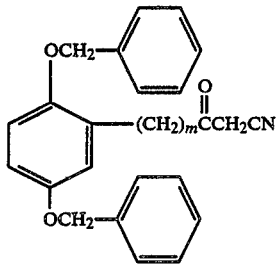

and subsequent deblocking can provide compounds wherein R is —$NH_2$. Compounds wherein R is —NH-$SO_2$—$R_1$ can be made by reacting the amine-substituted pyrazoles of the invention with an appropriate sulfonyl chloride such as methanesulfonyl chloride to form a bis methanesulfonamide and subsequently hydrolyzing the latter such as with NaOH to form the mono methanesulfonamide.

As discussed previously, the compounds of the invention are useful as silver halide developing agents and also may be used as intermediates in the preparation of dye developers such as azo or azomethine chrome-complexed dye developers. For one class of dye developers which can be made from the compounds of this invention reference is made to applicants' copending application Ser. No. 374,277 filed on even date herewith and now U.S. Pat. No. 4,656,117.

The following examples describe the preparation of compounds according to the invention and are intended to be illustrative.

EXAMPLE I

A solution of 90.45 g (0.18 mole) of a compound represented by the formula

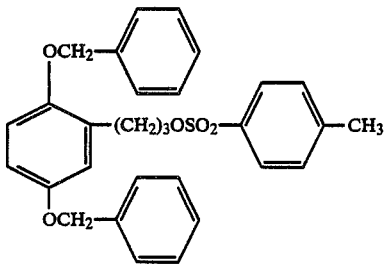

in 340 ml of diethylether and 400 ml of absolute ethanol was added over a period of 5½ hours with stirring under nitrogen to a refluxing solution of 117 g of 95% $H_2NNH_2$ and 13.5 g of water in 400 ml of absolute ethanol. The solution was then refluxed for an additional half hour. The reaction mixture was evaporated under vacuum. Water was added to the residue and then extracted twice with ether. The ether extracts were washed twice with water, dried over anhydrous sodium sulfate and the sodium sulfate was filtered off. A solution of ether saturated with hydrogen chloride gas was added to the filtrate with stirring until no more precipitation occurred. The precipitate was collected by filtration, washed with ether and dried to give 60 g of solid which was then recrystallized from 450 ml of isopropanol to give 52 g of a white solid represented by the formula

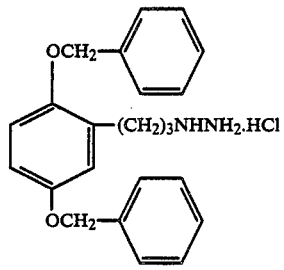

Compound III

A mixture of 1 g (0.0023 mole) of compound III and 0.377 g (0.0046 mole) of sodium acetate in 30 ml of absolute ethanol was stirred at room temperature for several minutes and then 1.1 g (0.00254 mole) of a compound represented by the formula

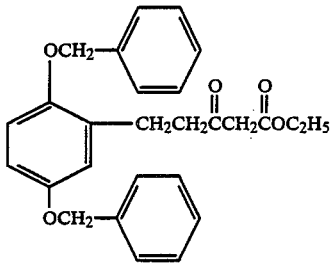

were added and the mixture stirred for 1½ hours. The solid which formed was filtered, washed with ethanol and then with water and dried to give 1.35 g of compound I, m.p. 93°-95° C.

$C_{48}H_{46}N_2O_5$ requires 78.90% C, 6.30% H, and 3.84% N. Elemental analysis found 78.75% C, 6.47% H, and 3.49% N.

EXAMPLE II

A solution of compound I (1.0 g) in 20 ml of methylene chloride was added dropwise to a solution of boron tribromide (2 ml) in 500 ml of methylene chloride at −78° C. The reaction mixture was stirred for one hour at −78° C. and then for one hour at 0° C. The mixture was cooled to −78° C., 100 ml of diethyl ether added and warmed to 0° C. The resulting solid was collected by filtration, dried under vacuum, treated with water and dried again to give compound II. The structure of the product was confirmed by proton NMR and thin layer chromatography.

Although the invention has been described in detail with respect to various embodiments thereof, these are intended to be illustrative only and not limiting of the invention but rather those skilled in the art will recognize that modifications and variations may be made which are within the spirit of the invention and the scope of the appended claims.

What is claimed is:

1. A photographic method which comprises treating an exposed silver halide emulsion with an aqueous alkaline processing composition including a silver halide developing agent which is represented by the formula

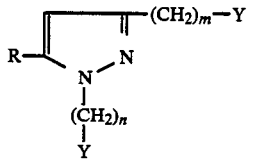

where R is —OH, —$NH_2$, or —$NHSO_2$—$R_1$; $R_1$ is alkyl having from 1 to 6 carbon atoms or phenyl; Y is a silver halide developing substituent or a precursor thereof; and m and n are the same or different and each is an integer of from 1 to 6.

* * * * *